US008824952B2

(12) United States Patent
Nishimura

(10) Patent No.: US 8,824,952 B2
(45) Date of Patent: Sep. 2, 2014

(54) IMAGE FORMING APPARATUS

(75) Inventor: Soichiro Nishimura, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 887 days.

(21) Appl. No.: 12/081,293

(22) Filed: Apr. 14, 2008

(65) Prior Publication Data

US 2008/0203646 A1 Aug. 28, 2008

Related U.S. Application Data

(63) Continuation of application No. 10/994,819, filed on Nov. 23, 2004, now Pat. No. 7,366,459.

(30) Foreign Application Priority Data

Dec. 26, 2003 (JP) ..... 2003-435822

(51) Int. Cl.
*G03G 15/00* (2006.01)
*G03G 21/00* (2006.01)
*B65H 3/44* (2006.01)

(52) U.S. Cl.
CPC .. *G03G 15/6502* (2013.01); *G03G 2215/00383* (2013.01); *G03G 2221/169* (2013.01)
USPC ..... 399/392

(58) Field of Classification Search
CPC ..... G03G 15/00; G03G 21/00; B65H 3/44
USPC ..... 399/388, 392, 393
IPC ..... G03G 15/00; B65H 3/44,13/10
See application file for complete search history.

(56) References Cited

U.S. PATENT DOCUMENTS

| | | | | |
|---|---|---|---|---|
| 4,204,668 | A | 5/1980 | Yanagawa | |
| 5,008,715 | A | 4/1991 | Imaizumi et al. | |
| 5,332,323 | A | 7/1994 | Murai et al. | |
| 5,387,043 | A * | 2/1995 | Fujioka et al. | 400/691 |
| 5,418,606 | A | 5/1995 | Kikuchi et al. | |
| 5,526,104 | A | 6/1996 | Kawano | |
| 5,692,231 | A * | 11/1997 | O et al. | 399/23 |
| 5,725,207 | A | 3/1998 | Deguchi | |
| 6,267,368 | B1 | 7/2001 | Tomoe et al. | |
| 6,612,763 | B1 | 9/2003 | Yoshihara | |
| 6,738,590 | B2 * | 5/2004 | Okimura et al. | 399/111 |
| 6,767,149 | B2 | 7/2004 | Yoshihara | |

(Continued)

FOREIGN PATENT DOCUMENTS

| | | | |
|---|---|---|---|
| JP | A-57-456928 | 9/1982 | |
| JP | 63112328 A * | 5/1988 | G03G 15/00 |

(Continued)

*Primary Examiner* — Nguyen Ha
(74) *Attorney, Agent, or Firm* — Oliff PLC

(57) ABSTRACT

An image forming apparatus, comprising a case that accommodates an image forming unit; a sheet cassette that is capable of moving relative to the case; and a cover disposed above the sheet cassette, wherein the cover covers a side of the case in which the sheet cassette is removably set in the case, the cover is capable of opening and closing, and a slot, through which a sheet is capable of being inserted, is formed between the cover and the sheet cassette with a lower end of the cover defining an upper end of the slot.

23 Claims, 13 Drawing Sheets

(56) References Cited

U.S. PATENT DOCUMENTS

| | | | | |
|---|---|---|---|---|
| 6,902,161 | B2 | 6/2005 | Gordon et al. | |
| 6,923,586 | B2 | 8/2005 | Yoshihara | |
| 7,058,352 | B2 | 6/2006 | Ozawa et al. | |
| 7,142,805 | B2 | 11/2006 | Mizuno et al. | |
| 2004/0114979 | A1* | 6/2004 | Nanno | 399/392 |
| 2005/0141947 | A1 | 6/2005 | Nishimura | |
| 2008/0012199 | A1* | 1/2008 | Kim et al. | 271/9.09 |

FOREIGN PATENT DOCUMENTS

| | | | | | |
|---|---|---|---|---|---|
| JP | 02249842 | A | * | 10/1990 | G03G 15/00 |
| JP | A-04-094352 | | | 3/1992 | |
| JP | U-04-100133 | | | 8/1992 | |
| JP | A-05-333616 | | | 12/1993 | |
| JP | A-07-302032 | | | 11/1995 | |
| JP | 07333932 | A | * | 12/1995 | G03G 15/00 |
| JP | A-07-333932 | | | 12/1995 | |
| JP | A-08-169569 | | | 7/1996 | |
| JP | 09118453 | A | * | 5/1997 | G03G 15/00 |
| JP | A-2000-280570 | | | 10/2000 | |
| JP | 2002356235 | A | * | 12/2002 | G03G 15/00 |
| JP | A-2002-365235 | | | 12/2002 | |
| KR | 20-1997-53822 | | * | 10/1997 | |

* cited by examiner

IMAGE FORMING APPARATUS

INCORPORATION BY REFERENCE

This is a Continuation of application Ser. No. 10/994,819 filed Nov. 23, 2004, which in turn claims priority from Japanese Patent Application No. 2003-435822, filed Dec. 26, 2003. The disclosures of the prior applications are hereby incorporated by reference herein in their entirety.

BACKGROUND OF THE INVENTION

1. Field of Invention

The invention relates to an image forming apparatus.

2. Description of Related Art

There exists a printer, for example, in U.S. Pat. No. 6,612,763, in which a front cover of the printer includes a manual slot through which a sheet is manually inserted and fed into the printer. With such a structure, printing is favorably performed on thick paper such as postcards.

SUMMARY OF THE INVENTION

When a paper jam occurs in the printer, the front cover is opened in order to clear the paper jam. However, as disclosed in U.S. Pat. No. 6,612,763, for example, when a paper jam occurs before the sheet completely passes through the manual slot that passes through the front cover, the front cover is difficult to open. If the front cover is forcibly opened, the paper may possibly tear.

Accordingly, one exemplary aspect of this invention is to provide an image forming apparatus that favorably feeds a sheet that is manually inserted therein and that readily clears a paper jam.

An exemplary image forming apparatus may include a case that accommodates an image forming unit; a sheet cassette that is capable of moving relative to the case; and a cover disposed above the sheet cassette, wherein the cover covers a side of the case in which the sheet cassette is removably set in the case, the cover is capable of opening and closing, and a slot, through which a sheet is capable of being inserted, is formed between the cover and the sheet cassette with a lower end of the cover defining an upper end of the slot.

Another exemplary image forming apparatus may include a case that accommodates an image forming unit; a sheet cassette that is capable of moving relative to the case; and a cover disposed above the sheet cassette, wherein the cover covers a side of the case in which the sheet cassette is removably set in the case, the cover is capable of opening and closing, and a slot, through which a sheet is capable of being inserted, is formed between the cover and the sheet cassette with an upper end of the sheet cassette defining a lower end of the slot.

Another exemplary image forming apparatus may include a case that accommodates an image forming unit; a sheet cassette that is capable of moving relative to the case; and a cover disposed above the sheet cassette, wherein the cover covers a side of the case in which the sheet cassette is removably set in the case, the cover is capable of opening and closing, and a slot, through which a sheet is capable of being inserted, is formed between the cover and the sheet cassette with an upper end of the sheet cassette defining a lower end of the slot.

Another exemplary method of forming a slot through which a sheet is inserted in order to supply the sheet to an image forming portion, may include the step of forming a gap between a lower surface of a cover that covers a side of a case and a sheet cassette disposed below the cover, wherein the sheet is fed to the image forming portion through the gap.

BRIEF DESCRIPTION OF THE DRAWINGS

Embodiments will be described in detail with reference to the following figures in which like elements are labeled with like numbers and in which.

DETAILED DESCRIPTION OF PREFERRED EMBODIMENTS

Embodiments of the invention will be described in detail with reference to the figures. With reference to FIGS. 1 through 5, a laser beam printer 1 as an example of an image forming apparatus according to a first embodiment of the invention will be described.

Figure 1:
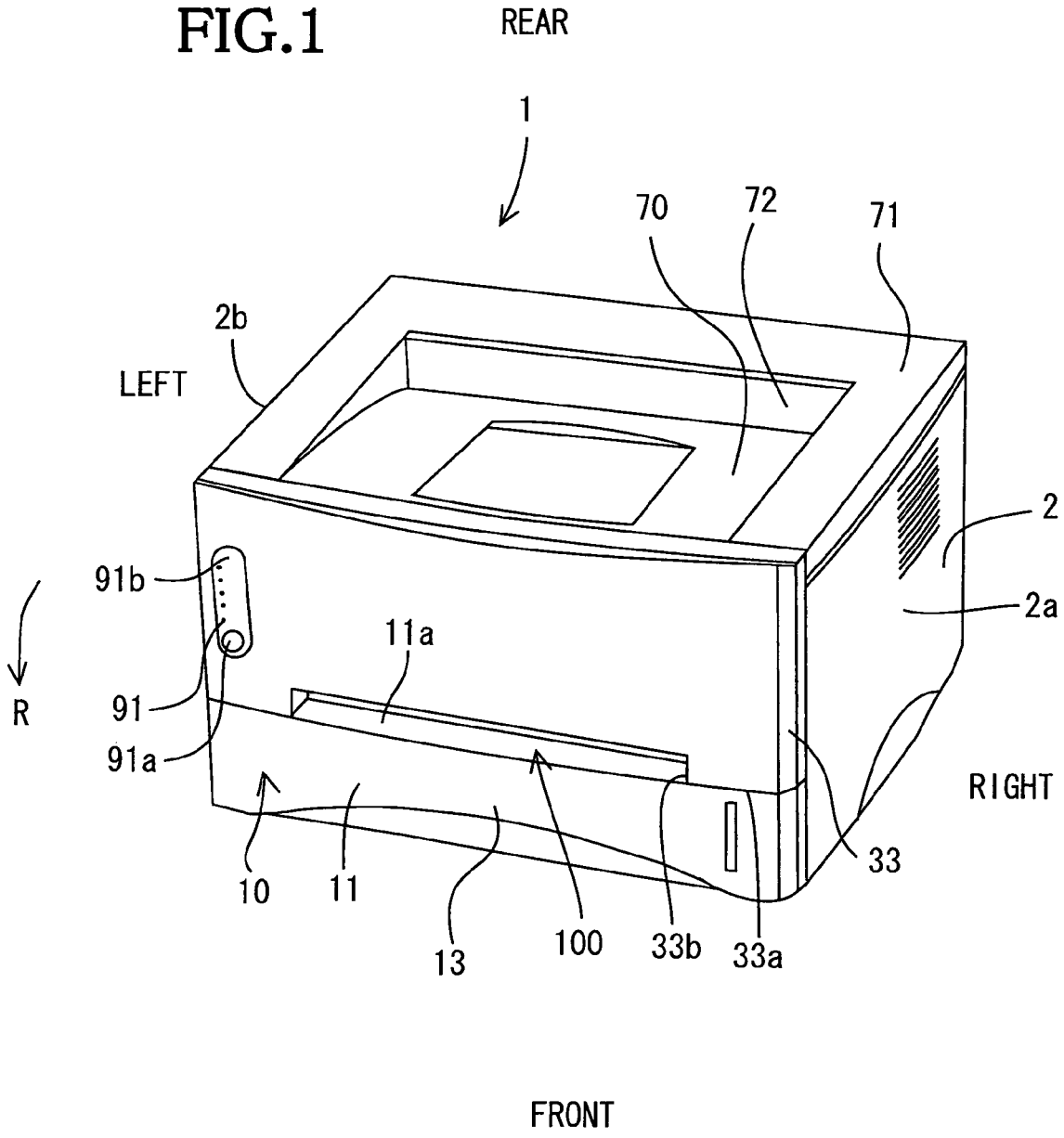
FIG. 1 is a perspective view of a laser beam printer according to an embodiment of the invention.
Figure 2:
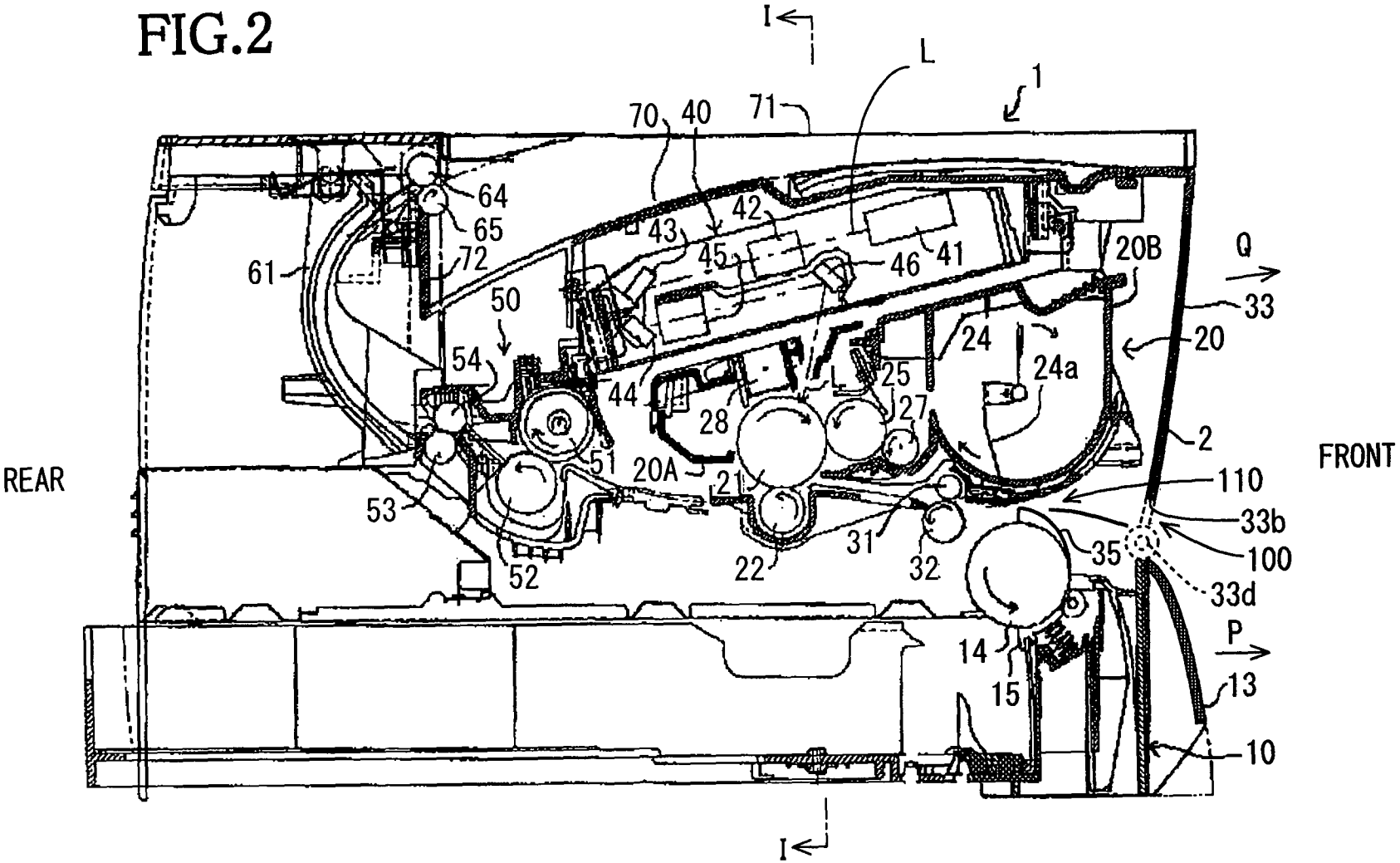
FIG. 2 is a side sectional view of the laser beam printer.

As shown in FIGS. 1 and 2, the laser beam printer 1 has a case 2 with side walls 2*a*, 2*b*. Disposed in a lower part of the case 2 is a sheet cassette 10 that mounts thereon a stack of sheets and is provided with a grip 13. The sheet cassette 10 is removably set in the case 2. The sheet cassette 10 is drawn toward the front side of the printer 1 in the direction P, as shown in FIG. 2, to remove the cassette 10 from the case 2. The sheet cassette 10 is provided with a sheet mount plate (not shown) that is urged upwardly by a spring (not shown).

Disposed above the sheet cassette 10 is a pick-up roller 14 rotatably supported in the case 2 of the printer 1 in the direction of the arrow (counterclockwise), and a separation pad 15 disposed in confrontation with the pick-up roller 14. An uppermost sheet on the sheet mount plate contacts the pick-up roller 14 and is separated with the aid of the separation pad 15.

As shown in FIG. 1, disposed on a front face of the printer 1 is a control panel 91 including an operation button 91*a* and a LED (light-emitting diode) 91*b*, as well as a manual slot 100 through which a sheet is manually inserted into the printer 1.

As shown in FIG. 2, a process cartridge 20 is disposed above the sheet cassette 10. The process cartridge 20 is also removably set in the case 2. When a paper jam occurs or the process cartridge 20 is replaced, the process cartridge 20 is drawn in the direction of arrow Q, to remove the process cartridge 20 from the case 2.

Figure 3:
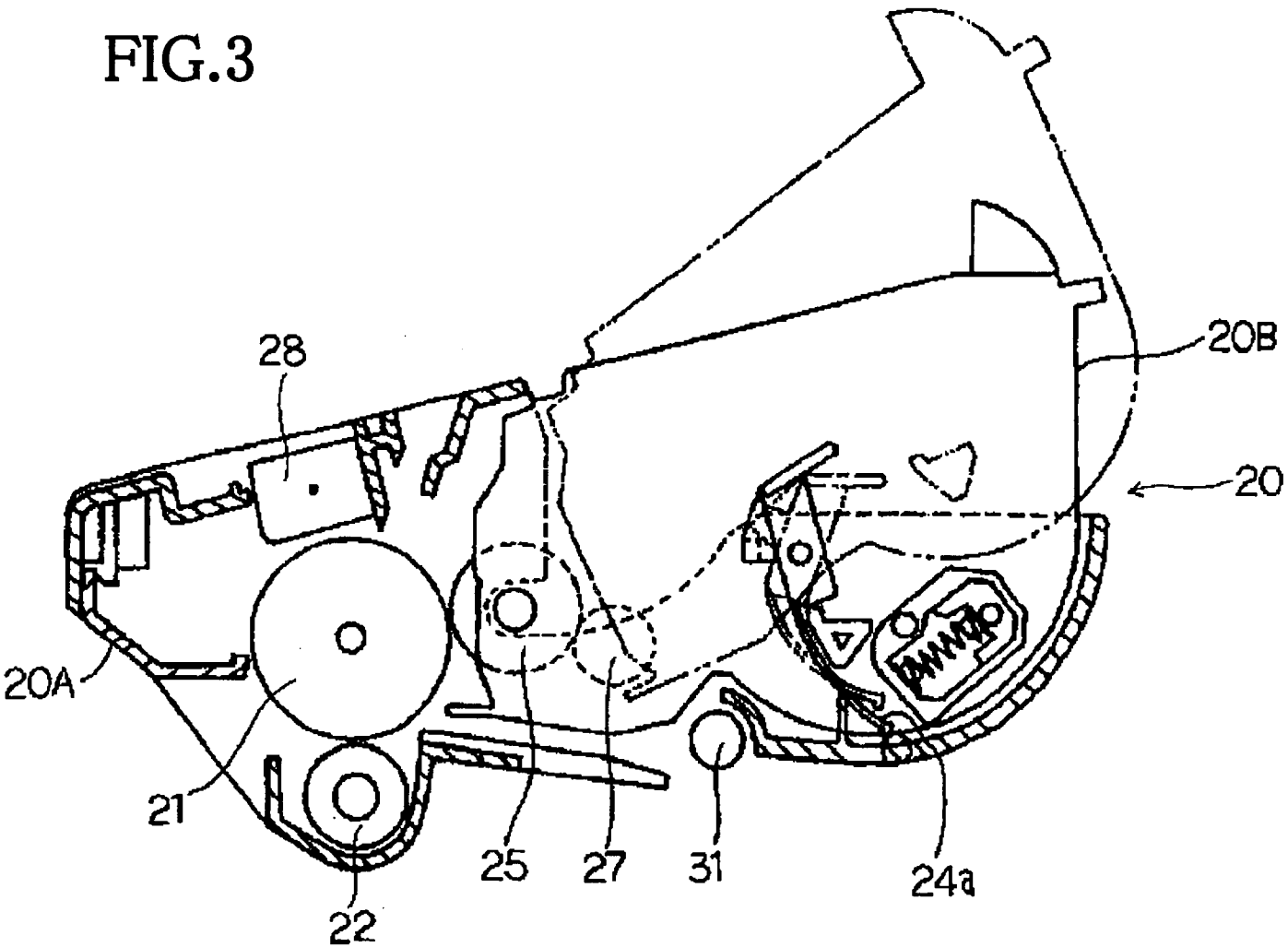
FIG. 3 is a side sectional view of a process unit of the laser beam printer.

As shown in FIG. 3, the process cartridge 20 includes a photosensitive member cartridge 20A and a developing cartridge 20B detachably mounted on the photosensitive member cartridge 20A. The photosensitive member cartridge 20A includes a photosensitive drum 21 that carries toner image thereon, a transfer roller 22 that transfers the toner image carried on the photosensitive drum 21 onto the sheet, and a scorotron charger 28 that uniformly charges a surface of the photosensitive drum 21 by generating corona discharge. The developing cartridge 20B includes a developing agent chamber 24 (in FIG. 2) that contains toner, a developing roller 25 that supplies toner to the photosensitive drum 21, and a supply roller 27 that supplies toner to the developing roller 25. Disposed in the developing agent chamber 24 is an agitator 24*a* that agitates toner in the chamber 24.

The photosensitive member cartridge 20A and the developing cartridge 20B are separable from each other. When the process cartridge 20 is removed from the case 2 of the printer 1, the photosensitive member cartridge 20A and the developing cartridge 20B are together removed from the case 2, without being separated from each other.

Figure 6:
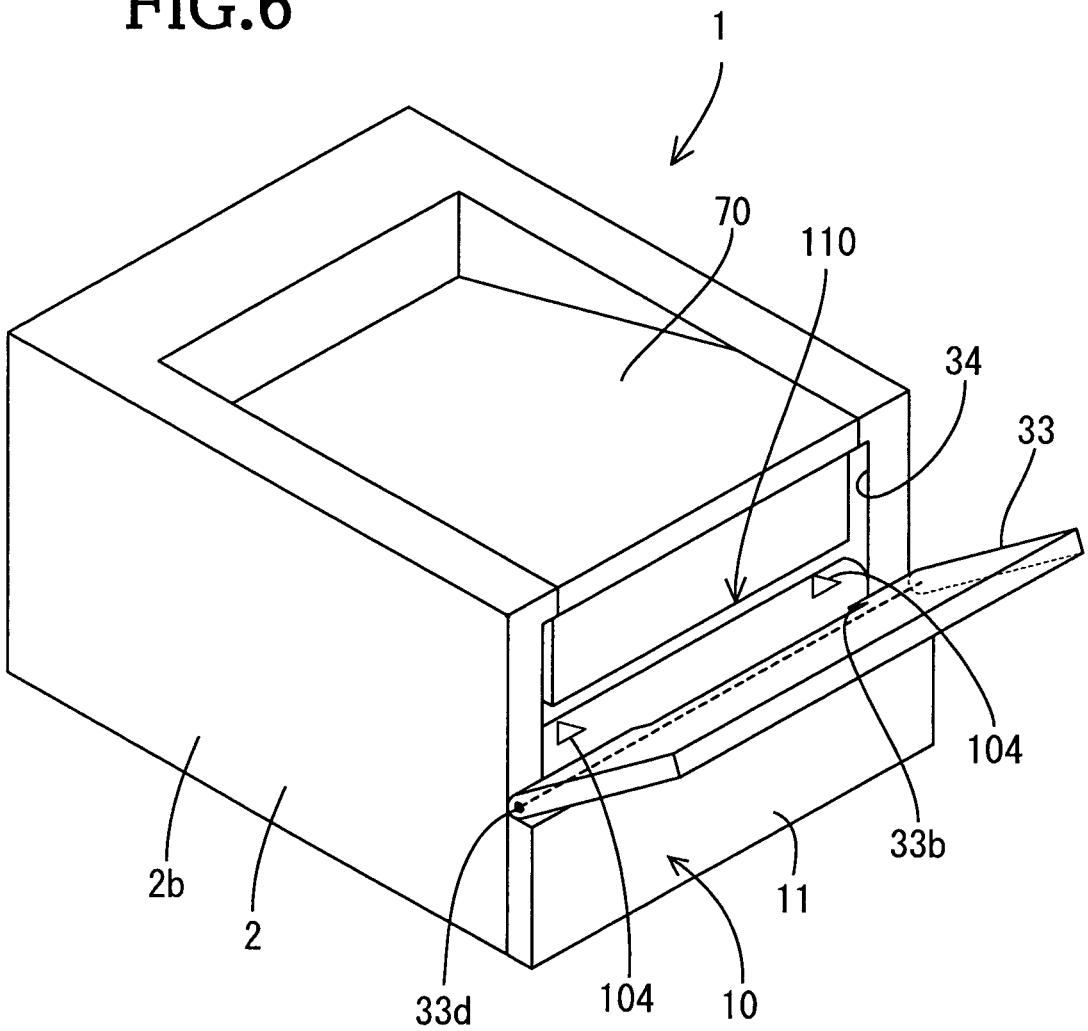
FIG. 6 is a perspective view of the laser beam printer showing an open front cover.

A front cover 33 is disposed on a front side of the printer 1 where the sheet cassette 10 is removably set in the case 2. A shaft 33*d* is disposed on a lower end of the front cover 33. The front cover 33 is rotatable about the shaft 33*d*. In FIG. 1, the direction R indicates the rotating direction of the front cover 33 when it is opened. In FIG. 6, an axis of the shaft 33*d* is indicated by the broken lines.

As shown in FIG. 6, formed in the case 2 of the printer 1 is an opening 34 through which the process cartridge 20 is removably set in the case 2. When the front cover 33 is closed, the opening 34 is covered by the front cover 33, as shown in FIG. 1. As the front cover 33 is rotated clockwise in FIG. 2, the opening 34 is uncovered, so that the process cartridge 20 can be removably set in the case 2 from the front side of the printer 1.

As shown in FIG. 2, a pinch roller 31 and a register roller 32 are rotatably disposed between the process cartridge 20 and the sheet cassette 10.

Disposed above the process cartridge 20 are a laser scanner unit 40 that includes a laser emitting section (not shown) that emits a laser beam, a polygon mirror 41, lenses 42, 45, and reflecting mirrors 43, 44, 46. The surface of the photosensitive drum 21 is irradiated with laser beam that is deflected by the polygon mirror 41 and passes through the lens 42, the reflecting mirrors 43, 44, the lens 45, and the reflecting mirrors 46. Thus, an electrostatic latent image is formed on the surface of the photosensitive drum 21.

A fixing unit 50 that fixes toner onto the sheet is disposed behind the process cartridge 20. The fixing unit 50 includes a heat roller 51 provided with a heat source, a pressure roller 52 in pressure contact with the heat roller 51, and a pair of feed rollers 53, 54. As the sheet is fed between the heat roller 51 and the pressure roller 52, toner melts due to the application of heat and is fixed onto the sheet by the application of pressure. The feed rollers 53, 54 feed the sheet having toner fixed. As shown in FIG. 2, a chute 61 that is formed into a curve and reverses a sheet feeding direction, is pivotally disposed behind the feed rollers 53, 54.

Formed on an upper face of the case 2 is a discharge tray 70 that stacks thereon sheets that have passed through the chute 61. Disposed on an extension of the chute 61 is a pair of discharge rollers 64, 65 that support the sheet fed along the chute 61 and discharge the sheet onto the discharge tray 70.

As the chute 61 is rotated rearward, the sheet is not discharged onto the discharge tray 70 but discharged onto the chute 61. When the sheet, which is manually inserted through the slot 100, is a thicker sheet of paper, the chute 61 is rotated rearward so that the sheet is substantially straightly discharged from the case 2 onto the chute 61. Thus, the thick sheet can be fed reliably.

A projection 71 is formed on a periphery of the discharge tray 70 (on the right, left and rear sides of the printer 1 in FIG. 1), with an upper surface of the projection 71 flat. As shown in FIGS. 1 and 2, a stepped portion is formed between the discharge tray 70 and the projection 71.

Figure 4:
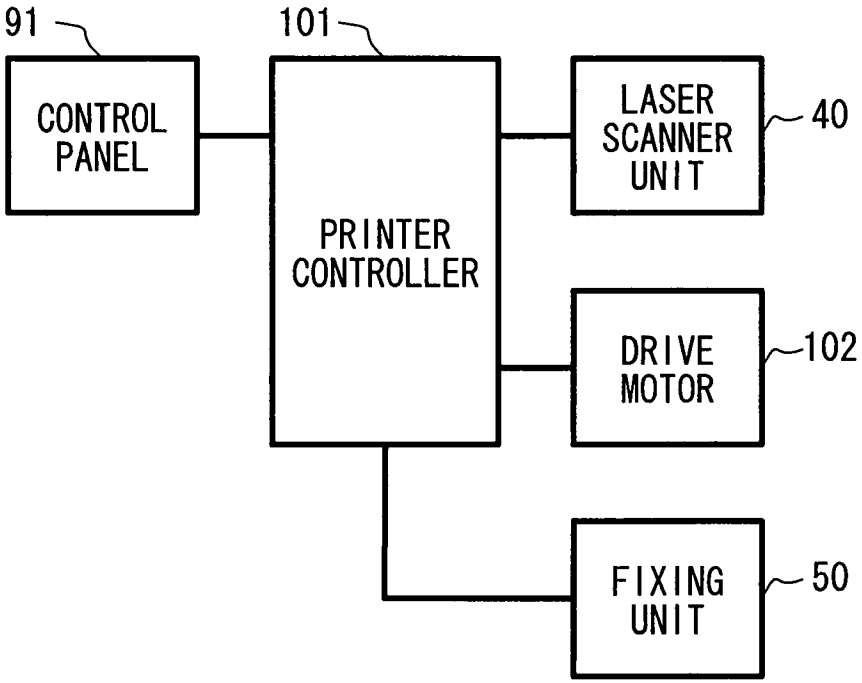
FIG. 4 is a block diagram for controlling the laser beam printer.

As shown in FIG. 4, the control panel 91, the laser scanner unit 40, the fixing unit 50, and a motor 102 are connected to a printer controller 101. Units of the printer 1 are controlled by the printer controller 101. Various rollers, such as the photosensitive drum 21, the developing roller 25, and the supply roller 27, are driven by the motor 102. The case 2 is arranged to accommodate the process cartridge 20, the laser scanner unit 40, and the fixing unit 50.

Sheet feeding will be described below. As the pick-up roller 14 is rotated at a predetermined timing, the sheets are supplied one by one from the sheet cassette 10. The sheet is fed between the pinch roller 31 and the register roller 32 through a sheet path 35. Skew of the sheet is corrected by the register roller 32 and fed between the photosensitive drum 21 and the transfer roller 22.

An electrostatic latent image is formed by a laser beam emitted from the laser scanner unit 40 on the surface of the photosensitive drum 21 that is charged by the charger 28. As a portion of the photosensitive drum 21 where the electrostatic latent image is formed, is brought into confrontation with the developing roller 25, toner supplied to the photosensitive drum 21 through the supply roller 27 and the developing roller 25, makes the electrostatic latent image visible and thus, a visible toner image is formed on the photosensitive drum 21. The toner image is transferred onto the sheet when the sheet passes between the photosensitive drum 21 and the transfer roller 22.

When the sheet having the toner image transferred thereon passes between the heat roller 51 and the pressure roller 52, heat and pressure are applied to toner to fuse the toner image onto the sheet.

The sheet is then fed between the feed rollers 53, 54 and discharged, through the chute 61, onto the discharge tray 70 by the discharge rollers 64, 65 with the printed side facing down and an end of the sheet contacting an end wall 72.

The manual slot 100 will be described below. The sheet cassette 10 is slidable relative to the case 2, as described above. The front cover 33 is pivotally provided above the sheet cassette 10, so as to open and close. The manual slot 100 is defined by a space between the upper end of the sheet cassette 10 and the lower end of the front cover 33.

Figure 12A:
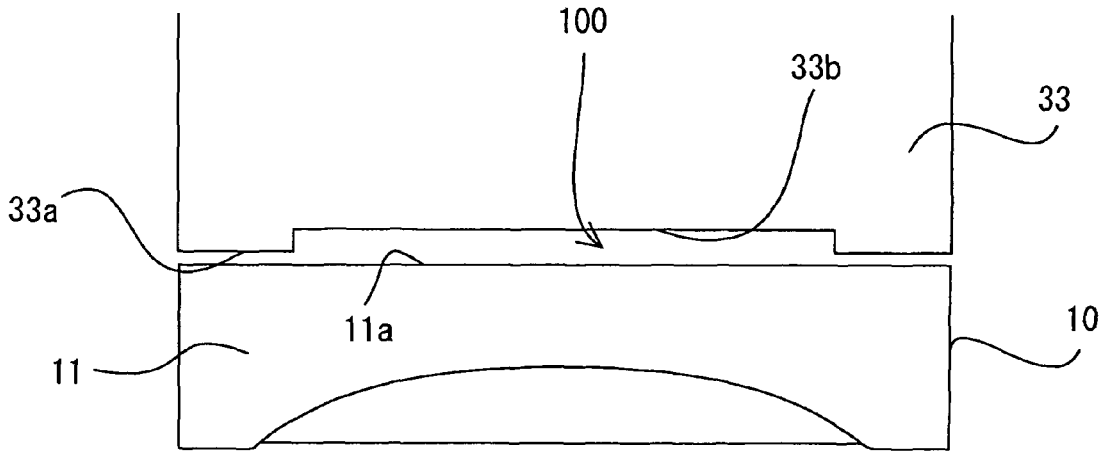
FIGS. 12A-12C are front views of various manual slots.
Figure 12B:
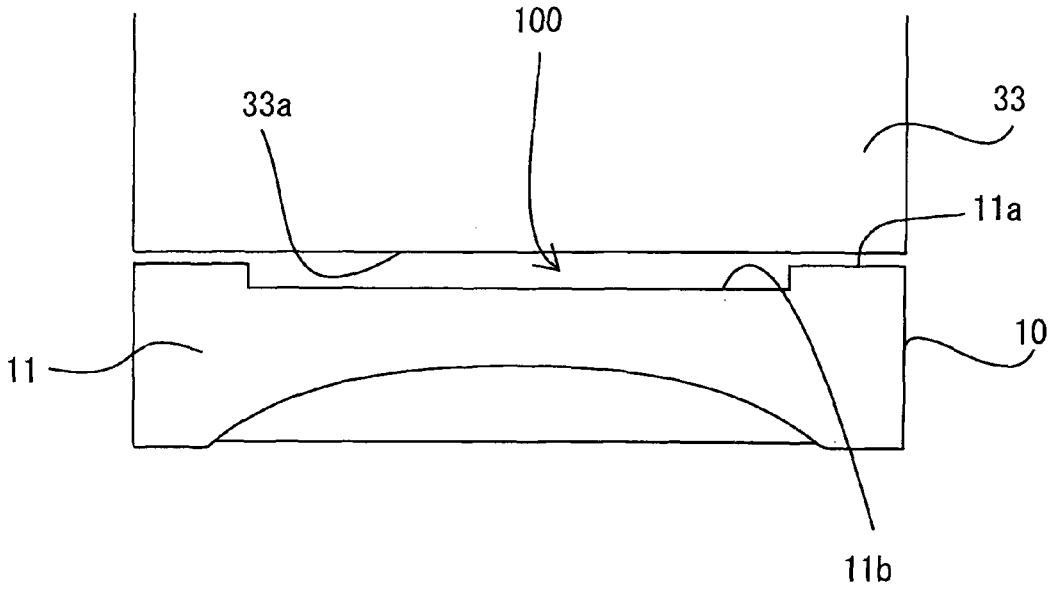
Figure 12C:
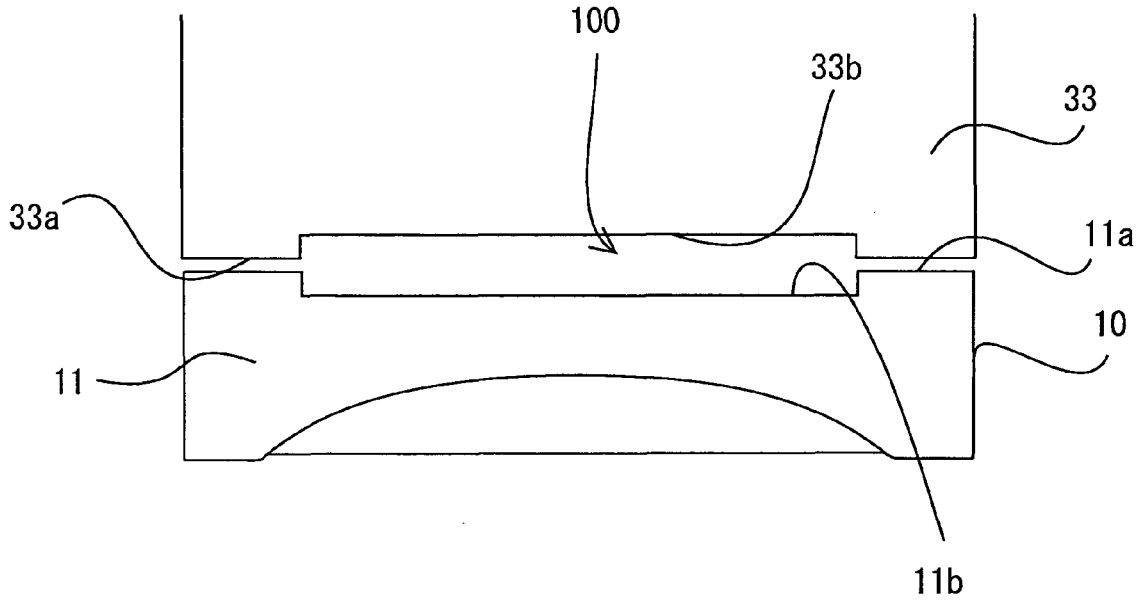

With reference to FIGS. 12A to 12C, the shape of the manual slot 100 will be described.

As shown in FIG. 12A, for example, a cut portion 33*b* having a substantially rectangular shape, is formed on a lower end 33*a* of the front cover 33. An upper end 11*a* of a front wall 11 of the sheet cassette 10 is formed flat. An area defined by the cut portion 33*b* and the upper end 11*a* functions as the manual slot 100. The sheet, inserted from the manual slot 100, is fed to the register roller 32 along a path that joins the sheet path 35 through a guide opening 110.

The length (i.e., left to right as show in FIG. 12A) of the cut portion 33*b* is slightly longer than the width of the sheet P typically used in the printer 1. For example, when a letter size sheet P having the width of 8.5 inches is typically used, an appropriate length of the cut portion 33*b* is about 9 to 9.5 inches.

The height of the cut portion 33*b* is set so that one sheet can pass through the cut portion 33*b*. However, it is desirable that the height of the cut portion 33*b* be set to about 5 to 10 mm, because it is difficult to insert the sheet P through the slot 100 if the height is too low, and dust or foreign matter enters into the case 2 if the height is too high.

As shown in FIG. 12B, as another example, the lower end 33*a* of the front cover 33 is formed flat, and a cut portion 11*b* is formed on the upper end 11*a* of the front wall 10 of the sheet cassette 10. An area defined by the cut portion 11*b* and the lower end 33*a* of the front cover 33 functions as the manual slot 100. The sheet inserted from the manual slot 100 is fed to the register roller 32 along the path that joins the sheet path 35, through the guide opening 110.

The length and height of the cut portion 11*b* may be set to substantially the same length and height described above in conjunction with the first example.

As shown in FIG. 12C, in yet another example, the cut portion 33*b* is formed on the lower end 33*a* of the front cover 33, and the cut portion 11*b* is formed on the upper end 11*a* of the front wall 10 of the sheet cassette 10. An area defined by the cut portions 11*b*, 33*b* functions as the manual slot 100. The sheet inserted from the manual slot 100 is fed to the register roller 32 along the path that joins the sheet path 35 through a guide opening 110.

In this example, the manual slot 100 is formed by the cut portions 11*b*, 33*b*. The length of the cut portions 11*b*, 33*b* may be set to substantially the same as that of the first example. The height of each of the cut portions 11*b*, 33*b* may be set to half the height of the cut portion 33*b* of the first example, so that the height of the manual slot 100 is about the same as the height of the cut portion 33 of the first example.

Figure 5:
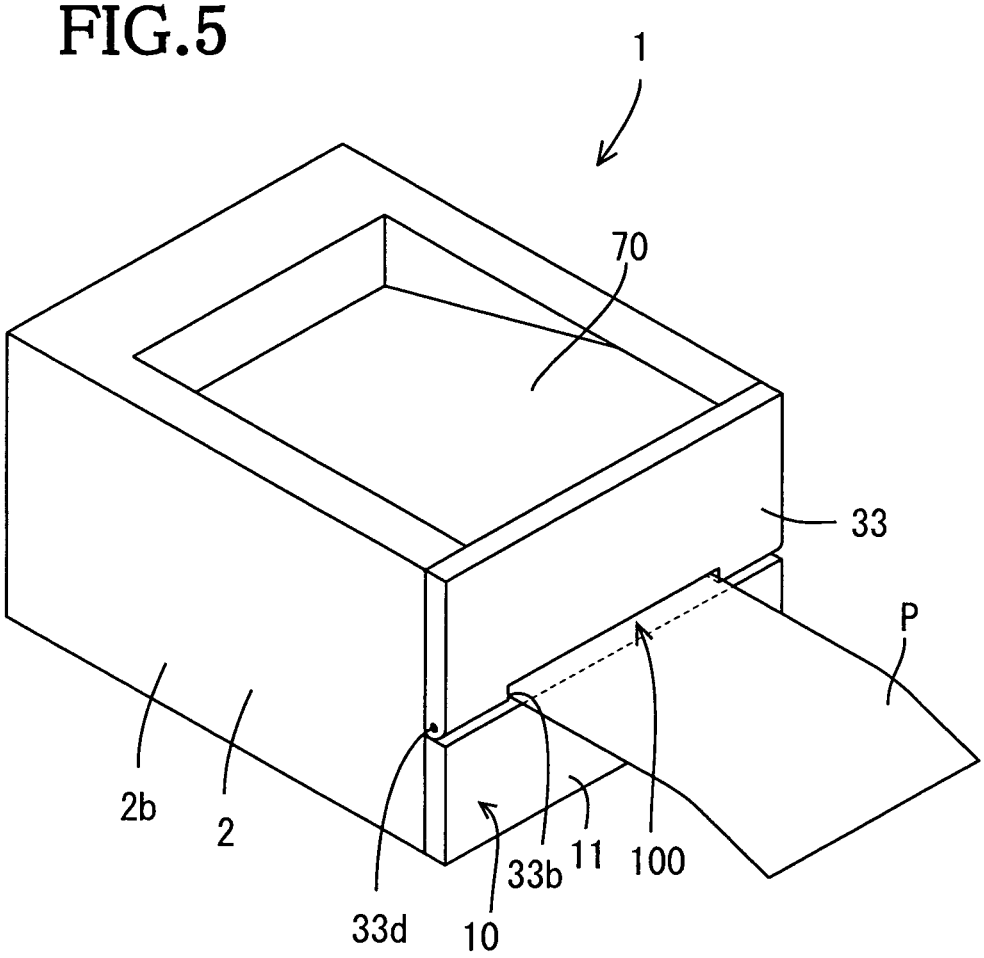
FIG. 5 is a perspective view of the laser beam printer showing a sheet inserted into the laser beam printer.

As shown in FIGS. 5 and 6, the front cover 33 has a free end on an upper side thereof and the shaft 33*d* on a lower side thereof that extends parallel to the longitudinal direction of the front cover 33. The front cover 33 is pivotally supported by the case 2 at about the shaft 33*d*. When the opening 34 is closed by closing the front cover 33, as shown in FIG. 5, the sheet can be inserted from the manual slot 100.

With the opening 34 uncovered by opening the front cover 33 at a predetermined angle, as shown in FIG. 6, a rear portion of the manual slot 100 is exposed and the upper end 11*a* of the sheet cassette 10 disposed below the manual slot 100 can be seen.

By simply forming the cut portions 11*b* or 33*b*, the manual slot 100 with an appropriate size can be formed. The size of the sheets that the printer 1 can guide is determined by the length of the cut portions 11*b*, 33*b*.

The guide opening 110 that leads to the sheet path 35 is provided behind the manual slot 100 in a sheet insertion direction from the manual slot 100. At the opening 34 of the case 2 above the sheet cassette 10, a space of a predetermined size that is connected to the guide opening 110 is provided. With the front cover 33 rotated at a predetermined angle, as shown in FIG. 6, the guide opening 110 can be seen through the space.

A pair of indicators 104 that indicate positions where at least one side of the sheet P should pass, are provided on the upper end 11*a* of the sheet cassette 10 at positions recognizable with the front cover 33 rotated at the predetermined angle.

Figure 7:
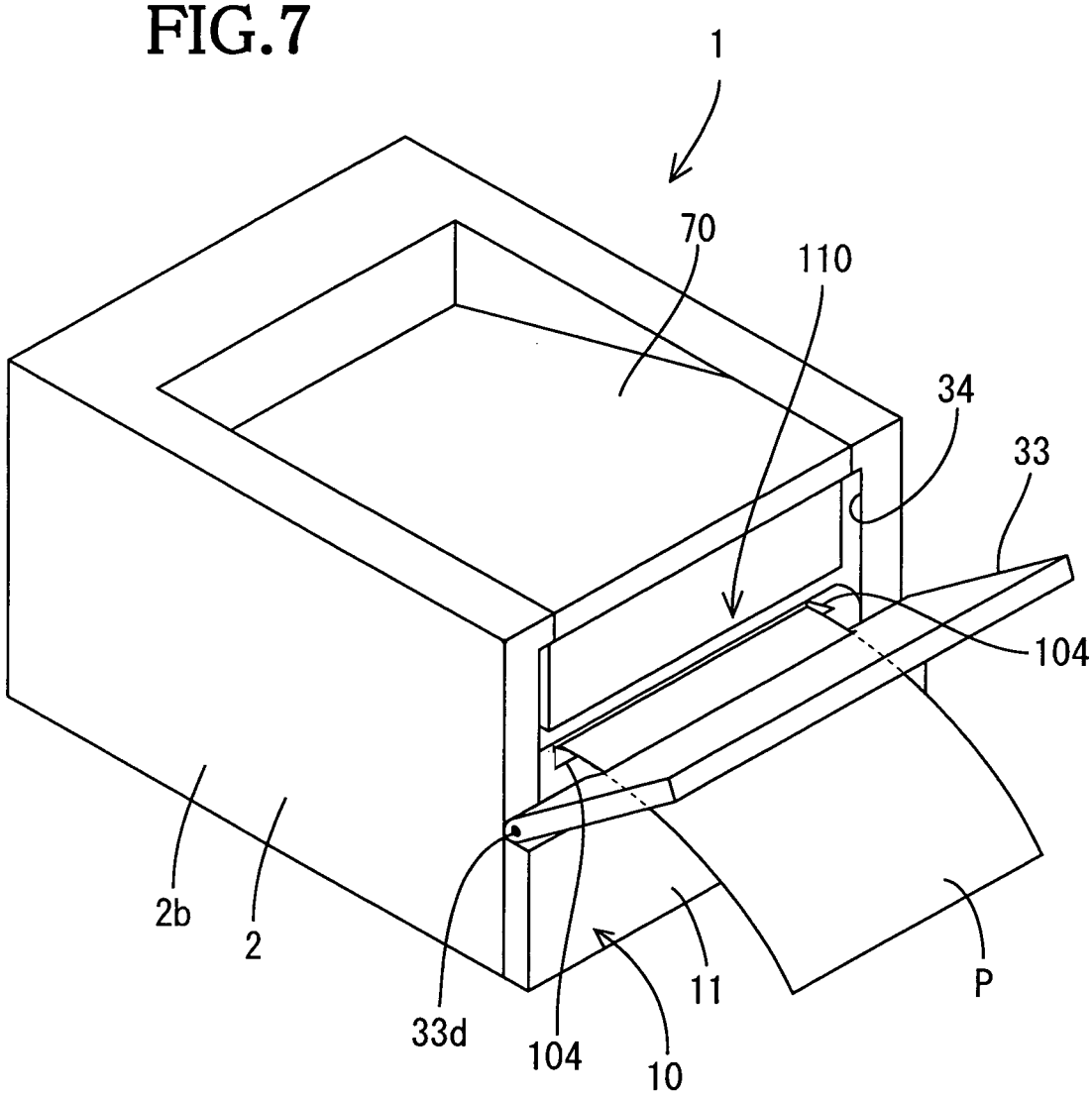
FIG. 7 is a perspective view of the laser beam printer showing a sheet manually inserted, with the front cover open.

The sheet P is inserted through the manual slot 100, with the front cover 33 closed as shown in FIG. 5. To check the position of the manually inserted sheet P, the front cover 33 is pivotally moved at the predetermined angle, so that a relation between the sheet P, the indicators 104, and the guide opening 110 can be checked, as shown in FIG. 7. After the check, the front cover 33 is closed to feed the sheet P into the case 2. Thus, positional deviation or misalignment of the sheets P that are manually inserted from the slot 100 can be prevented.

In FIGS. 6 and 7, a pair of indicators 104 is provided for the printer 1 for indicating the positions where sides of the sheet P, which is manually inserted from the slot 100, are to pass. However, only one indicator 104 may be provided for the printer 1.

Figure 8A:
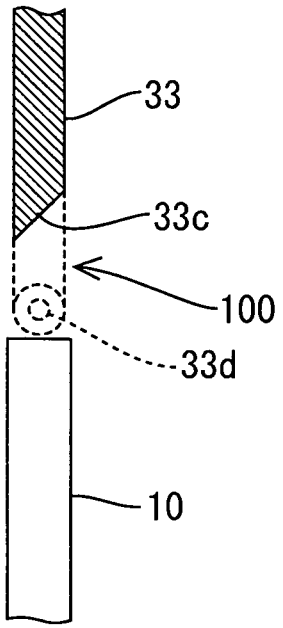
FIGS. 8A and 8B are side views of a manual slot.
Figure 8B:
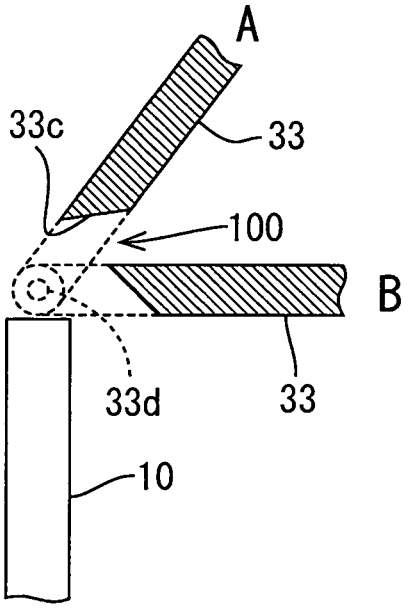

With reference to FIGS. 8A and 8B, a modified example of the manual slot 100 will be described below. FIG. 8A shows a state of the front cover 33 that is closed. The manual slot 100 is formed by the cut portion 33*b* on the lower end 33*a* of the front cover 33. An upper end 33*c* of the cut portion 33*b* is angled. The height of the manual slot 100 is gradually reduced inwardly. With such a structure, the sheet P can be readily inserted from the slot 100 because the height of the slot 100 on a side from which the sheet P is inserted is wider.

FIG. 8B shows the states A and B of the front cover 33 in which the front cover 33 is half open and completely open, respectively. In the state A, the front cover 33 is pivotally moved at a predetermined angle and the upper end 33*c* of the cut portion 33*b* is substantially parallel to the horizontal plane. Therefore, the sheet P can be readily inserted from the slot 100 substantially horizontally, with the front cover 33 open.

In the state B, the position of the manual slot 100 cannot be seen from the front side, so that the sheet P cannot be inserted from the slot 100. Therefore, it is preferable that a stopper be disposed in order to stop the front cover 33 at a predetermined position or at a position before the front cover 33 is completely open.

In the first embodiment, the manual slot 100 is provided between the front cover 33 and the sheet cassette 10. Therefore, opening/closing operations of the front cover 33 can be readily performed, without being influenced by the sheet P that is inserted from the slot 100. In other words, the sheet P partially inserted does not contact the front cover 33 when the front cover 33 is opened. When a paper jam occurs with the sheet P partially inserted into the case 2 through the manual slot 100, the front cover 33 can be opened or closed without being influenced by the jammed sheet, when the paper jam is cleared. Thus, the front cover 33 can be readily open and the sheet P cannot be torn when the paper jam is cleared.

While the printer 1 allows a compact accommodation of the sheet cassette 10 in the case 2, the manual slot 100 is formed by effectively employing the space between the sheet cassette 10 and the front cover 33. Thus, an increase in the height of the printer 1 can be minimized and savings in the space of the printer 1 can be achieved.

The lower end 33*a* of the front cover 33 constitutes a part of the manual slot 100. As the front cover 33 is open, the space rearward of the manual slot 100 above the sheet cassette 10 is exposed. Thus, by opening the front cover 33, the condition of the sheet P, which is manually supplied, can be readily checked.

For users who are not accustomed to manual sheet insertion or are not accustomed to expensive or valuable sheets, the sheet P, when the sheet P is manually inserted from the slot 100, can be easily checked.

With the front cover 33 open, the guide opening 110 leading to the sheet path 35 can be seen, so that the sheet P can be manually set or inserted precisely. Such a structure is very useful for users who are not accustomed to manual sheet insertion and do not know how far the sheet has to be inserted inward, or who use expensive or valuable sheets.

As the indicators 104 are provided on the upper end 11*a* of the sheet cassette 10, the indicators 104 can be seen when the front cover 33 is open. Therefore, when the sheet P is manually inserted from the slot 100, the guide mark for manually setting or inserting the sheet P can be readily identified. Thus, setting or insertion of the sheet P can be precisely made. The indicators 104 can only be seen when the front cover 33 is open. Therefore, the indicators 104 do not affect the appearance of the printer 1, and the indicators 104 and appearances of the printer 1 can be designed independently.

Figure 9:
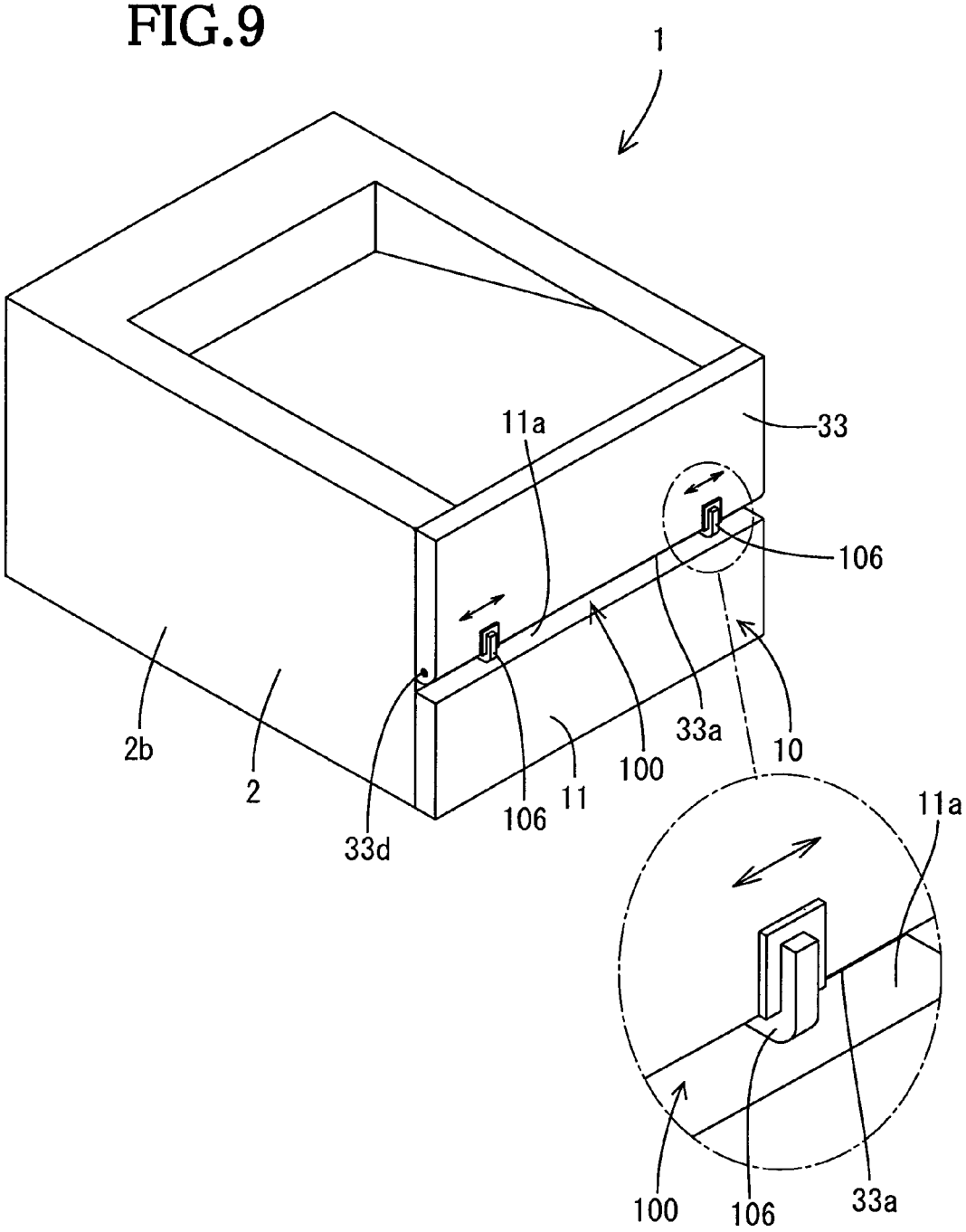
FIG. 9 is a perspective view of a laser beam printer according to a second embodiment.

A second embodiment of the invention will be described with reference to FIG. 9. A gap of the predetermined distance is provided between the upper end 11*a* of the sheet cassette 10 and the lower end 33*a* of the front cover 33. The gap functions as the manual slot 100. A pair of guide members 106 that guide the sides of the sheet inserted from the manual slot 100, is provided on the lower end 33*a* of the front cover 33. The guide members 106 are slidable in the longitudinal direction of the front cover 33. The guide members 106 move closer to and away from each other. As one guide member 106 is moved, the other guide member 106 is moved in association with the one guide member 106. As a pair of the guide members 106 is provided on the lower end 33*a* of the front cover 33, the distance that the guide members 106 can slide can be increased.

In the second embodiment, the cut portion 33*b* as provided in the first embodiment, is not provided, but the gap that functions as the manual slot 100 is formed between the upper end 11*a* of the sheet cassette 10 and the lower end 33*a* of the front cover 33. However, the cut portions 33*b*, 11*b* may be provided, as shown in FIGS. 12A to 12C, and a pair of the guide members 106 may be disposed on a lower end of the cut portion 33*b* or an upper end of the cut portion 11*b*.

As described above, with the guide members 106, skew of the sheet P that is manually inserted from the slot 100 can be effectively prevented.

Figure 10:
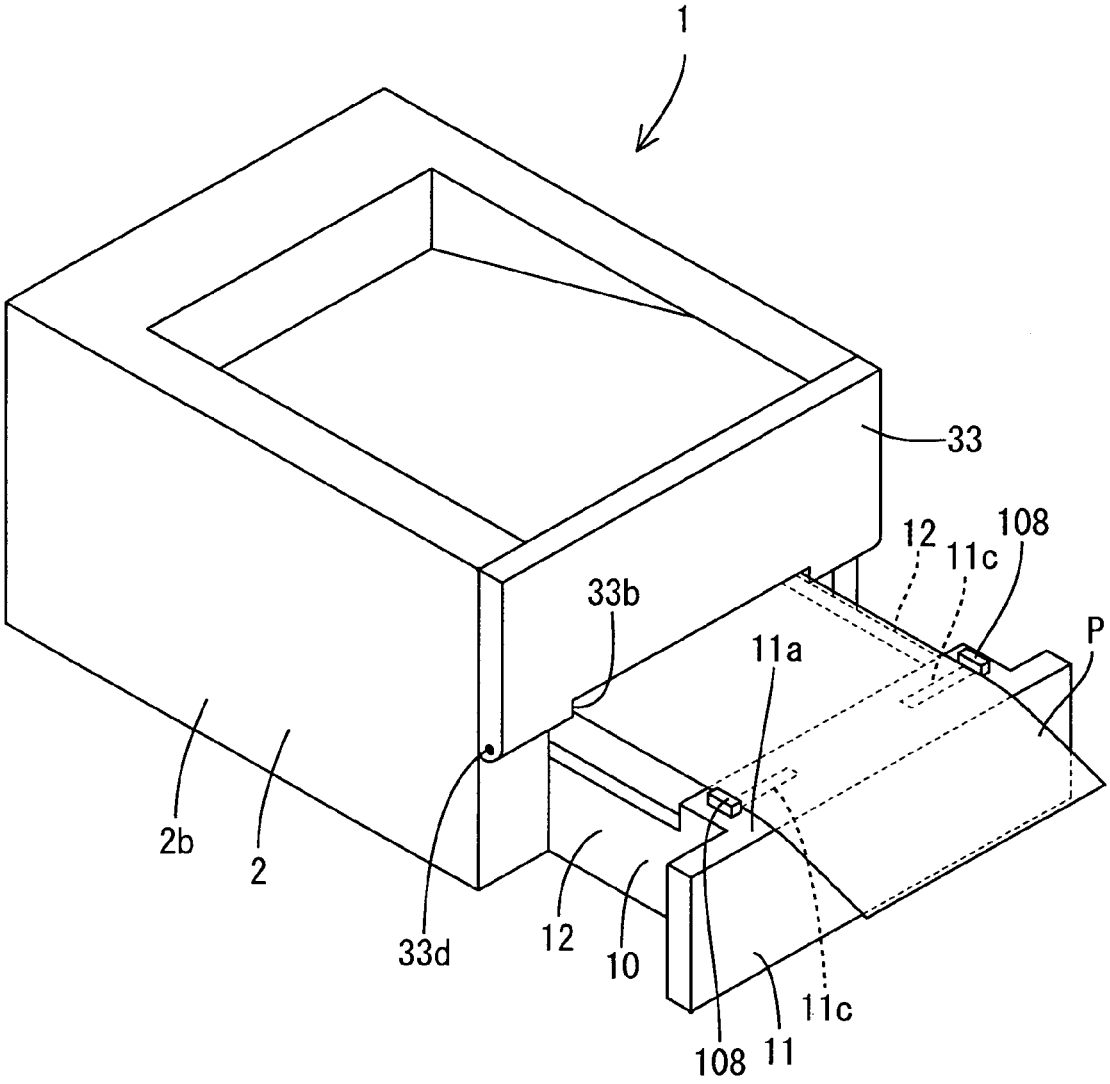
FIG. 10 is a perspective view of a laser beam printer according to a third embodiment.

A third embodiment of the invention will be described below with reference to FIG. 10. In the third embodiment, the sheet P inserted form the manual slot 100 is supported by the sheet cassette 10 drawn out from the case 2 by a predetermined length. A pair of guide members 108 is provided on the upper end 11*a* of the front wall 11 of the sheet cassette 10. A pair of the guide members 108 is slidable on the upper end 11*a* of the sheet cassette 10 in the right-left direction. Formed on the upper end 11*a* is a pair of grooves 11*c* in which the guide members 108 fit. The guide members 108 are slidably moved along the grooves 108, so that the guide members 108 are positioned in association with the size of the sheet P, which is inserted from the manual slot 100.

As described above, with the guide members 108, skew of the sheet P that is manually inserted from the slot 100 can be effectively prevented. The sheet P manually inserted from the slot 100 is supported by the upper end 11*a* having a relatively large area, so that the sheet P can be stably supplied into the case 2, through the slot 100. Skew of the sheet P that is manually inserted from the slot 100 can be effectively prevented since sides of the sheet P can be guided by the guide members 108, as well as the slot 100.

As a pair of the guide members 108 is provided on the upper end 11*a* of the front wall 11 of the sheet cassette 10, the distance that the guide members 108 can slide can be increased.

The front wall 11 that defines a front face of the sheet cassette 10 serves as a supporter that supports the sheet P, as well as a guide that guides the sheet P with respect to the width direction thereof. Therefore, the sheet P can be inserted properly and fed stably without increasing the number of components to be used for the printer 1.

While the invention has been described with reference to the exemplary embodiments, the description of the exemplary embodiments is illustrative only and is not be construed as limiting the scope of the invention. Various other modifications and changes may occur to those skilled in the art without departing from the sprit and the scope of the invention.

Figure 11:
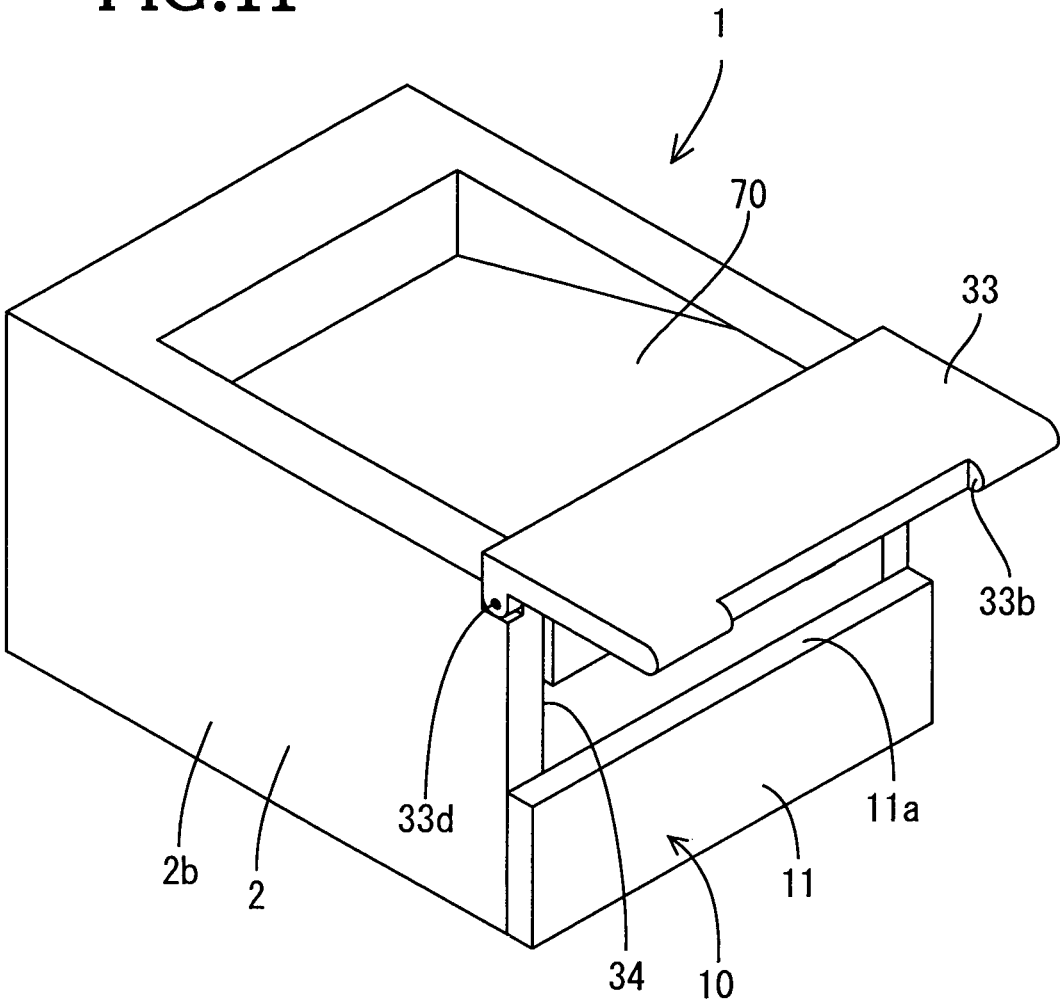
FIG. 11 is a perspective view of a laser beam printer according to a fourth embodiment.

In the above-described embodiments, the front cover 33 has a free end on its upper side and is supported by the case 2 so as to pivot about the shaft 33*d* provided on its lower side. However, the front cover 33 may have a free end on its lower side and be supported by the case 2, so as to pivot about the shaft 33*d* provided on an upper side thereof, as shown in FIG. 11.

What is claimed is:

1. An image forming apparatus comprising:

a case that accommodates an image forming unit, the image forming unit comprising a process cartridge;

a sheet cassette that is configured to accommodate a sheet therein; and a cover disposed above the sheet cassette, the cover being configured to be pivoted about a lower end of the cover such that the cover is movable between an open position and a closed position such that the process cartridge is removable from the case when the cover is at the open position and the process cartridge is not removable from the case when the cover is at the closed position, wherein:

a slot is formed below the cover, a lowest end of the cover defining an upper end of the slot, the cover is disposed at an outermost portion of the image forming apparatus at a position adjacent to the slot, the cover is configured such that a sheet is inserted into the slot while the cover is at the closed position, the sheet inserted from the slot is transferred to the process cartridge when the cover is at the closed position, and the cover is rotatably supported by the case so as to pivot about an axis that is above the slot.

2. The image forming apparatus according to claim 1, wherein the slot is a gap disposed below the cover and above the sheet cassette.

3. The image forming apparatus according to claim 1, wherein the lowest end of the cover is a continuous straight edge that extends from a left side of the cover to a right side of the cover, and the lowest end of the cover does not define lateral sides of the slot.

4. The image forming apparatus according to claim 3, wherein the lateral sides of the slot are defined by a member of the image forming apparatus other than the cover.

5. The image forming apparatus according to claim 1, further comprising:

a guide member that guides a side of the sheet that is inserted into the slot, wherein the guide member is provided between the cover and the sheet cassette.

6. The image forming apparatus according to claim 5, wherein the guide member is slidably adjustable.

7. The image forming apparatus according to claim 1, wherein an upper end of the cover is a free end that is movable toward and away from the case, the cover is rotatably supported by the case so as to pivot about the axis provided on the lower end of the cover when the free end is moved toward and away from the case, and when the cover is opened at a predetermined angle by moving the free end away from the case, the process cartridge is exposed so as to be exchangeable by a user.

8. The image forming apparatus according to claim 1, wherein the image forming apparatus includes a U-shaped sheet feed path from the slot to a discharge tray of the image forming apparatus.

9. An image forming apparatus comprising:

a case that accommodates an image forming unit, the image forming unit comprising a process cartridge;

a sheet cassette that is configured to accommodate a plurality of sheets therein and that is movable into and out of the case;

a cover disposed above the sheet cassette on a front side of the case, the cover being pivoted about a lower end of the cover such that the cover is movable between an open position and a closed position such that the process cartridge is removable from the case when the cover is at the open position and the process cartridge is not removable from the case when the cover is at the closed position; and a slot disposed below the cover, a lowest end of the cover defining an upper end of the slot, wherein:

the cover is disposed at an outermost portion of the image forming apparatus at a position adjacent to the slot, the slot is exposed on the front side of the case when the cover is at the closed position, when the cover is at the closed position, a sheet can be inserted into the case through the slot so as to be transferred to the process cartridge, and the cover is rotatably supported by the case so as to pivot about an axis that is above the slot.

10. The image forming apparatus according to claim 9, wherein the slot is a gap disposed below the cover and above the sheet cassette.

11. The image forming apparatus according to claim 9, wherein the lowest end of the cover is a continuous straight edge that extends from a left side of the cover to a right side of the cover, and the lowest end of the cover does not define lateral sides of the slot.

12. The image forming apparatus according to claim 9, further comprising:

a guide member that guides a side of the sheet that is inserted into the slot, wherein the guide member is provided between the cover and the sheet cassette.

13. The image forming apparatus according to claim 12, wherein the guide member is slidably adjustable.

14. The image forming apparatus according to claim 9, wherein an upper end of the cover is a free end that is movable toward and away from the case, the cover is pivotably supported by the case so as to rotate about the axis provided on the lower end of the cover when the free end is moved toward and away from the case, and when the cover is opened at a predetermined angle by moving the free end away from the case, the process cartridge is exposed so as to be exchangeable by a user.

15. The image forming apparatus according to claim 9, wherein the image forming apparatus includes a U-shaped sheet feed path from the slot to a discharge tray of the image forming apparatus.

16. An image forming apparatus comprising:

a case having a front side, a rear side, and left and right sides;

an image forming unit disposed within the case, the image forming unit comprising a process cartridge;

a sheet cassette disposed at a lower end of the image forming apparatus, the sheet cassette configured to accommodate a plurality of sheets therein and to be movable into and out of the case;

a cover disposed on the front side of the case above the sheet cassette, the cover being pivotal about a lower end of the cover such that the cover is movable between an open position and a closed position such that the process cartridge is removable from the front side of the case when the cover is at the open position and the process cartridge is not removable from the case when the cover is at the closed position, a lowest end of the cover is a continuous straight edge that extends from a left side of the cover to a right side of the cover; and a slot formed below the cover, the lowest end of the cover defines an upper end of the slot, wherein:

the cover is disposed at an outermost portion of the image forming apparatus at a position adjacent to the slot, a sheet path is defined from the slot past the process cartridge such that, when the cover is at the closed position, a sheet can be inserted into the case through the slot and transferred along the sheet path to the process cartridge, and the cover is rotatably supported by the case so as to pivot about an axis that is above the slot.

17. The image forming apparatus according to claim 16, wherein the lowest end of the cover does not define lateral sides of the slot.

18. The image forming apparatus according to claim 17, wherein the lateral sides of the slot are defined by a member of the image forming apparatus other than the cover.

19. The image forming apparatus according to claim 16, wherein an upper end of the cover is a free end that is movable toward and away from the case, the cover is rotatably supported by the case so as to rotate about the axis provided on the lower end of the cover when the free end is moved toward and away from the case, and when the cover is opened at a predetermined angle by moving the free end away from the case, the process cartridge is exposed so as to be exchangeable by a user.

20. The image forming apparatus according to claim 16, wherein the image forming apparatus includes a U-shaped sheet feed path from the slot to a discharge tray of the image forming apparatus.

21. The image forming apparatus according to claim 1, wherein no tray is located outside of the cover.

22. The image forming apparatus according to claim 9, wherein no tray is located outside of the cover.

23. The image forming apparatus according to claim 16, wherein no tray is located outside of the cover.

* * * * *